US008226810B2

(12) United States Patent
Henzirohs

(10) Patent No.: US 8,226,810 B2
(45) Date of Patent: Jul. 24, 2012

(54) GALVANIC DEPOSITION METHOD FOR AN ANTHRACITE COLOURED COATING AND METALLIC PARTS PROVIDED WITH THE COATING

(75) Inventor: Christophe Henzirohs, Sonceboz (CH)

(73) Assignee: Universo S.A., La Chaux-de-Fonds (CH)

( * ) Notice: Subject to any disclaimer, the term of this patent is extended or adjusted under 35 U.S.C. 154(b) by 179 days.

(21) Appl. No.: 12/727,095

(22) Filed: Mar. 18, 2010

(65) Prior Publication Data

US 2010/0239881 A1 Sep. 23, 2010

(30) Foreign Application Priority Data

Mar. 20, 2009 (EP) ..... 09155762 A

(51) Int. Cl.
*C25D 5/48* (2006.01)
*C25D 3/62* (2006.01)

(52) U.S. Cl. ..... 205/223; 205/250; 428/672; 428/935

(58) Field of Classification Search ..... None
See application file for complete search history.

(56) References Cited

U.S. PATENT DOCUMENTS

| | | | | | |
|---|---|---|---|---|---|
| 1,924,439 | A | * | 8/1933 | Kersten | 205/250 |
| 3,285,699 | A | * | 11/1966 | Dulski et al. | 436/5 |
| 3,342,568 | A | * | 9/1967 | Capillon | 428/630 |
| 3,502,548 | A | | 3/1970 | Lyons, Jr. | |
| 4,261,738 | A | * | 4/1981 | Valentine et al. | 75/744 |
| 4,274,908 | A | * | 6/1981 | Fishter et al. | 216/90 |
| 4,299,864 | A | * | 11/1981 | Bly | 427/160 |
| 4,302,246 | A | * | 11/1981 | Brindisi et al. | 75/715 |
| 5,139,739 | A | * | 8/1992 | Takayanagi et al. | 420/507 |
| 6,299,056 | B1 | * | 10/2001 | Oota | 228/177 |
| 2008/0261025 | A1 | | 10/2008 | Abys et al. | |

FOREIGN PATENT DOCUMENTS

| | | | |
|---|---|---|---|
| EP | 0 686 706 | A1 | 12/1995 |
| GB | 2227756 | * | 8/1990 |
| JP | 61-37980 | * | 2/1986 |
| JP | 63-121672 | * | 5/1988 |
| JP | 63-250487 | * | 10/1988 |

OTHER PUBLICATIONS

English translation of JP 63-250487, Oct. 1988.*

* cited by examiner

*Primary Examiner* — John J Zimmerman

(74) *Attorney, Agent, or Firm* — Sughrue Mion, PLLC

(57) ABSTRACT

The invention concerns a galvanic deposition method for an anthracite colored coating for metallic parts, including a first step of depositing a gold-nickel alloy by means of an electrolytic bath, characterized in that it includes a second step of treating said gold-nickel alloy by means of a diluted acid bath, containing an acid selected from among hydrochloric, hydrofluoric, phosphoric, nitric and sulphuric acid.

5 Claims, No Drawings

GALVANIC DEPOSITION METHOD FOR AN ANTHRACITE COLOURED COATING AND METALLIC PARTS PROVIDED WITH THE COATING

This application claims priority from European Patent Application No. EP 09155762.9 filed Mar. 20, 2009, the entire disclosure of which is incorporated herein by reference.

The invention relates to the field of galvanic deposition methods, starting from an electrolyte solution. It concerns, more specifically, a method of depositing an anthracite coloured coating for metallic parts to be used, for example, in watchmaking or jewellery.

These galvanic methods are well known to those skilled in the art and widely described in scientific literature. We will confine ourselves to recalling the principle. A bath, called an electrolyte, contains metallic species in ionic form. A potential difference is applied between two electrodes dipped into the electrolyte, so as to cause a reduction reaction in the ionic metallic species at the anode. When the parts to be treated, which are arranged on a support or in a basket, are brought to the potential of the anode, they are covered with a metallic film via the effect of the reduction reaction.

Several methods exist, based on various electrolytes, for coating metal parts, such as brass, bronze, steel or other metals, with an anthracite coloured metallic layer.

One of these is a method of depositing a nickel and zinc alloy, called "black nickel" to obtain an intense anthracite coloured deposition. It uses an electrolyte containing zinc, nickel and sulphur species. Although aesthetically very efficient, the black nickel method is not free of technical drawbacks. First of all, the parts thereby coated with a nickel-zinc alloy have to be coated with a varnish to prevent the deposited layer from oxidising and the anthracite colour from being damaged. This step of applying varnish adds to the complexity and cost of the method. Moreover, it is not suited to parts of small size, whose appearance is impaired by the varnish. Secondly, the electrolyte is chemically unstable, which causes reproducibility problems for the method. Finally, the support element used for holding the parts must be desmutted for a long time between two baths.

Two other methods, known as "black ruthenium" and "black rhodium", with reference to the majority metallic species that they contain, are also well known to those skilled in the art. They suffer in part from the same drawbacks as the black nickel method.

A last method, well known to those skilled in the art, is used for depositing an anthracite coloured coating. This is the "black gold" method, which uses a gold and nickel based electrolyte. This method does not require any post-treatment, it is simple to use and stable over time. Moreover, the support element provided for holding the parts can be used several times without being cleaned. Although technically advantageous compared to the black nickel, black ruthenium and black rhodium methods, the "black gold" method results in a similar appearance to parts treated by the black ruthenium and black rhodium methods, with an insufficiently strong anthracite shade being obtained.

It is an object of the present invention to overcome the aforecited drawbacks, by proposing a method of depositing anthracite coloured coating that is technically simple and provides a strong anthracite shade. More specifically, the invention concerns a galvanic deposition method for an anthracite coloured coating for metallic parts, including a first step of depositing a gold-nickel alloy by means of an electrolytic bath. According to the invention, the method includes a second step of treating said gold-nickel alloy by means of a diluted acid bath, containing an acid selected from among hydrochloric, hydrofluoric, phosphoric, nitric and sulphuric acid.

The acid treatment step of the gold-nickel alloy increases the intensity and attractiveness of the anthracite shade of the coating obtained. The method includes an additional step compared to the conventional gold-nickel method, but remains considerably simpler, more robust and cheaper than the black nickel, black ruthenium and black rhodium methods. It is, moreover, suitable for parts of all sizes.

The invention also concerns metallic parts that have an anthracite coloured coating formed of a gold-nickel alloy, whose nickel atom content is between 30 and 40 percent.

Other features and advantages of the present invention will appear more clearly from the following detailed description of an example embodiment of the method according to the invention, the example being given purely by way of non-limiting illustration.

The galvanic deposition method for an anthracite coloured coating for metallic parts according to the invention conventionally includes a first step of depositing a gold-nickel alloy by means of an electrolytic bath containing gold and nickel species. Gold-nickel alloy deposition parameters are standard and well known to those skilled in the art. The following procedure is indicated by way of example:

| | |
|---|---|
| Gold metal content: | 2 g/l |
| Nickel metal content: | 5 g/l |
| pH electrometric: | 5.6 |
| degree Baumé density: | 11 °Bé |
| Temperature: | 55° C. |
| Current density: | 2 A/dm2 |

Naturally, the aforementioned parameters are given by way of indication and can be altered depending upon the desired result. For example, an increase in current density can increase the gold-nickel alloy deposition speed.

The metallic parts to be treated, for example watch hands, dials or appliqués for dials, cases or movement parts, are positioned on a support element, called a "bouclard", or loose in a basket. The parts are made of metal, such as brass, steel, bronze, gold or any other metal that has the desired mechanical properties. Advantageously, they are coated with a sub-layer of a pure gold alloy or a gold alloy such as gold-cobalt, obtained by a galvanic or other method, and with a thickness of around 0.35 micrometers. In a variant, the parts for treatment are made of bare metal.

The support element is dipped into the electrolytic bath and brought to the potential of the anode. In a few minutes, a layer of a gold-nickel alloy of around 0.6 micrometers is deposited on the parts being treated, and they take the desired anthracite colour. The parts are then rinsed and dried. At this stage in the method of the invention, they exhibit the characteristic anthracite colour of the black gold galvanic method.

According to the invention, the galvanic deposition method for an anthracite coloured coating for metallic parts further includes a step of treating the gold-nickel alloy thereby deposited, by means of a diluted acid bath. Said bath contains an acid selected from among sulphuric, hydrochloric, hydrofluoric, phosphoric or nitric acid. The dilution is preferably comprised between 1 and 50 ml/l of concentrated acid, and the temperature is 20° C. Advantageously, a wetting agent is added to the acid bath.

In a first advantageous embodiment of the method according to the invention, the diluted acid bath contains a mixture of hydrochloric acid and hydrofluoric acid within the previously indicated dilution range. In a second advantageous embodiment, the diluted acid bath contains hydrochloric acid within the indicated dilution range, with the addition of a neutralising salt, ammonium bifluoride, with the chemical formula NH4HF2. In a particularly advantageous embodiment, the acid bath contains 10 ml/l dilute hydrochloric acid, 50 g/l of the aforementioned neutralising salt and 2 ml/l of a wetting agent.

The parts for treatment, coated by the gold-nickel alloy, are placed on a support or in a basket, then dipped into a diluted acid bath of the previously described type, for a period of time varying from a few seconds to a few minutes. They are then rinsed and dried.

The diluted acid bath has the effect of substantially intensifying the initial anthracite shade of the parts. The aesthetic appearance of the parts is thus improved simply, quickly and inexpensively.

Chemical analysis of the gold-nickel alloy that has undergone the acid treatment demonstrates a depletion in nickel of around 10 to 15 percent compared to the untreated alloy. The nickel atom content of the gold-nickel alloy thus treated is comprised between 30 and 40 percent, compared to 45 percent for the gold-nickel alloy as it is deposited. Moreover, the remaining nickel has been at least partially oxidised by the acid treatment. These chemical alterations to the gold-nickel alloy are the cause of the observed change in colour.

There is therefore presented a method of depositing an anthracite coloured coating for metallic parts that is technically simple, and that provides an aesthetically advantageous result. Of course, the deposition method according to the invention is not limited to the embodiments that have just been described and those skilled in the art could envisage various simple alterations and variants without departing from the scope of the invention as defined by the annexed claims.

What is claimed is:

1. A galvanic deposition method for an anthracite coloured coating for metallic parts, including a first step of depositing a gold-nickel alloy by means of an electrolytic bath, characterized in that it includes a second step of treating said gold-nickel alloy by means of a diluted acid bath, containing an acid selected from among hydrochloric, hydrofluoric, phosphoric, nitric and sulphuric acid, thereby forming an anthracite coloured coating formed of a gold-nickel alloy having a nickel atom content between 30 and 40 percent.

2. The galvanic deposition method according to claim 1, wherein the dilution of said acid is comprised between 1 and 50 ml/l of concentrated acid.

3. The method according to claim 1, wherein said diluted acid bath contains a mixture of hydrochloric acid and hydrofluoric acid.

4. The method according to claim 1, wherein said diluted acid bath contains hydrochloric acid with the addition of ammonium bifluoride.

5. The method according to claim 1, wherein said diluted acid bath further contains a wetting agent.

* * * * *